US005390865A

United States Patent [19]

Vandermolen et al.

[11] Patent Number: 5,390,865

[45] Date of Patent: Feb. 21, 1995

[54] PROCESSOR FOR CHIPPING AND SHREDDING VEGETATATION

[76] Inventors: Aldo Vandermolen, 16 Welsh Rd., Essex Fells, N.J. 07020; Terry Rhodes, 426 Olive St., Mulvane, Kans. 67110

[21] Appl. No.: 621

[22] Filed: Jan. 5, 1993

[51] Int. Cl.[6] ..... B02C 13/16; B02C 13/288

[52] U.S. Cl. ..... 241/101.7; 241/92

[58] Field of Search ..... 241/92, 183.6, 188.2, 241/194, 248.1, 101.2

[56] References Cited

U.S. PATENT DOCUMENTS

| | | | |
|---|---|---|---|
| 2,361,278 | 4/1943 | Evans | 83/11 |
| 2,856,134 | 10/1958 | Tornery | 241/194 X |
| 3,276,700 | 10/1963 | Eklund | 241/55 |
| 3,756,517 | 9/1973 | Hoch et al. | 241/56 |
| 3,917,176 | 11/1975 | Carlsmith | 241/55 |
| 4,824,034 | 4/1989 | Baker | 241/194 |
| 4,951,882 | 8/1990 | Ober | 241/55 |
| 5,240,189 | 8/1993 | Majkazak et al. | 24/92 X |

*Primary Examiner*—Douglas D. Watts

*Attorney, Agent, or Firm*—Thomas L. Adams

[57] ABSTRACT

A processor can chip and shred vegetation, including wood and one or more of various other materials, such as agricultural products, yard and garden debris or forestry brush and waste. The processor includes a housing having a hopper opening. A rotor is rotatably mounted in the housing. A driver such as a motor or drive shaft is adapted to drive the rotor. Cutters are mounted on the rotor to swing past the hopper opening. A hopper is mounted at the hopper opening on the housing for feeding material toward and past the cutters. The processor is structured to process wood having a rated diameter but the hopper opening is sized to accept various other materials in amounts exceeding the rated diameter.

53 Claims, 4 Drawing Sheets

FIG. 6
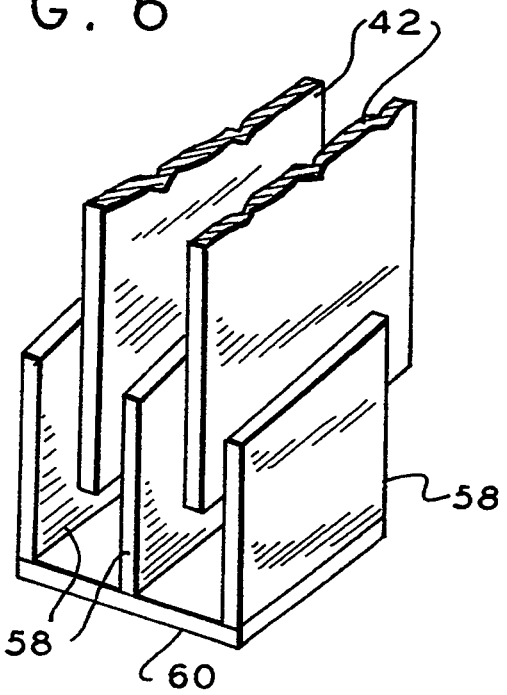
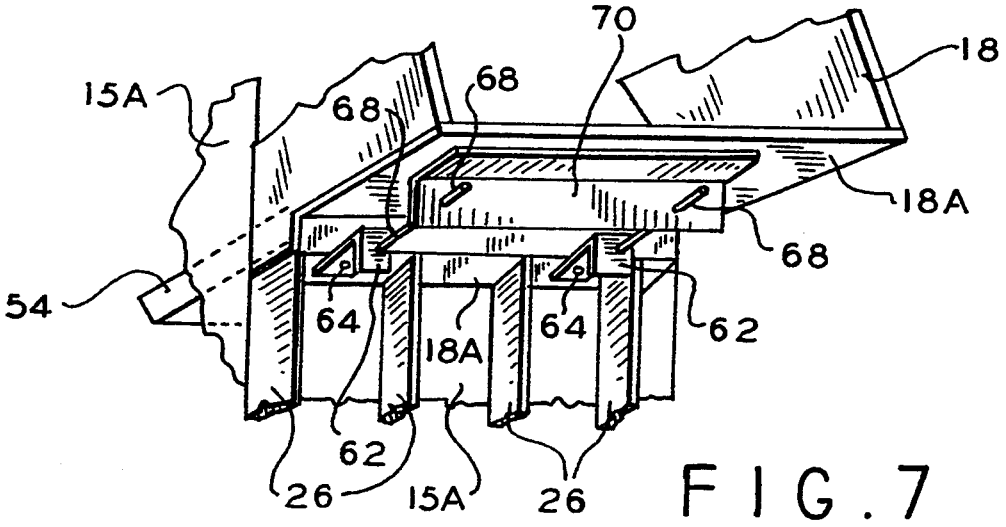
FIG. 7

PROCESSOR FOR CHIPPING AND SHREDDING VEGETATATION

BACKGROUND OF THE INVENTION

The present invention relates to processors for chipping and shredding vegetation and, in particular, to machines having cutters mounted on a rotor.

Known chippers have employed a relatively heavy, steel disk mounted in a cylindrical housing. The disk has slots where cutting blades are mounted. The. disk housing has a hopper for feeding branches and limbs through the side of a housing and into the spinning cutter blades. A cutter bed bar can be mounted in the cylindrical housing to subjacently support the lower edge of the hopper opening and provide a firm platform to hold the material against the action of the cutter blades. These known chippers can be driven by a gasoline engine or by a drive shaft adapted to be connected to the drive train of a tractor or other machine.

Chippers are normally designed to handle wood of a rated diameter. In some designs, the rating is determined by the material strength of the cutter blades and its supporting structure. Wood larger than the rating can produce excessive stress that may tend to permanently deform or break the chipper or cause excessive wear.

In some embodiments, the limitation on the diameter of wood that the chipper can handle is established by employing a drive shaft having shear bolts. Such drive shafts can be connected to a power source in a tractor or other mechanism. To ensure that excessive power is not applied to the chipper rotor, the drive shaft will disconnect when the shear bolt fractures under excessive load.

In other embodiments, the rating of the chipper is determined by the angular momentum stored in the chipper rotor. Such designs anticipate spinning a relatively heavy rotor at a high speed. Consequently, wood fed into the chipper blades would tend to slow the rotor but not unacceptably so if the wood is of a rated size. Since limbs and other material normally fed into a chipper tend to have a typical length to diameter ratio, manufacturers normally specify a diameter rating, which assumes a typical length. Therefore, a typical limb having a rated diameter (and therefore a typical rated length) can be fed into the chipper rotor without unacceptably reducing its speed and operating efficiency. If wood beyond the rating is fed into chippers of this type, the rotor will slow unacceptably or even stop.

An advantage with this type of design is the fact that the motor or drive shaft spinning the chipper rotor need not have the horsepower needed to supply all of the power required when the chipping is actually occurring. Instead, the motor can store kinetic energy in the rotor using a flywheel effect, so that energy can be withdrawn quickly during chipping without excessively loading the motor.

A conventional shredder can employ a plurality of coaxial disks mounted inside a cylindrical housing. Swinging bars or flails can be mounted between the coaxial disks to articulate and assist in the shredding process. While material to be chipped is brought to the side of a rotating disk, material to be shred conventionally is fed radially into the spaces between the rotating disks.

Chippers and shredders are often used by landscapers, farmers, foresters or others who must reduce various types of materials. For this reason, combined chipper/shredders have been designed. Such combined chipper/shredders have employed two hoppers, one to feed shreddable material radially between coaxial disks and another hopper to feed chippable material to the side of an outer disk carrying chipper blades. A disadvantage with this type of machine is the relative complexity and additional parts needed to accomplish the feeding of different materials along different paths. Also, these structures have required a relatively large number of flails to accomplish the shredding. Moreover, these machines have been relatively inefficient and needed 20 outlet screens to keep partially disintegrated material cycling within the housing before being disintegrated enough to pass through the holes of the screen.

Known shredders have included a vacuum hose that can be connected to the shredder hopper. Consequently, the vacuum hose can be brought to the debris, which is then sucked into the shredder.

U.S. Pat. No. 3,276,700 shows a wood chipper employing a rotary disk with angularly spaced knives and passageways. Material is fed to one side of the disk and chips pass through the other side while air is continuously circulated throughout the housing.

U.S. Pat. No. 3,756,517 shows a forage blower with a recutter. Material is transferred from the cutter to the impeller in the direction of rotation of the impeller. Therefore, the exit velocity of the material has a significant component towards the discharge opening. This assembly includes a perforated cylindrical screen or cage. Material passing through the cage is thrown into impeller paddles which sweep the recut materials into an outlet. See also U.S. Pat. Nos. 2,361,278; 3,276,700; 3,917,176; 4,951,882.

SUMMARY OF THE INVENTION

In accordance with the illustrative embodiments demonstrating features and advantages of the present invention, there is provided a processor for chipping and shredding vegetation, including wood and one or more of various other materials, such as agricultural products, yard and garden debris, or forestry brush and waste. This processor has a housing including a hopper opening. The processor has a rotor rotatably mounted in the housing and a drive means adapted to drive this rotor. A cutter is mounted on the rotor to swing past the hopper opening. The processor has a hopper mounted at the hopper opening on the housing for feeding the material toward and past the cutter. The processor is structured to process wood having a rated diameter. The hopper is sized to accept one or more of said various other materials in amounts exceeding said rated diameter.

In other embodiments of the same invention wherein the rating of the diameter of wood is not a factor, the above mentioned hopper opening has, at least partially, a polygonal border having one interior obtuse angle.

By employing apparatus of the foregoing type, an improved processor is achieved in which a single hopper can handle both chipping and shredding. In a preferred embodiment, a pair of coaxial disks are mounted inside a cylindrical housing. Preferably the disks are closely spaced and relatively large to accommodate a high volume of material. Chipper blades mounted at slots in one of the disks at various positions sweep an annular area. A preferred hopper feeds material into the face of the disk carrying the cutter blades for processing. The preferred processor has a stationary cutter bar mounted at the hopper opening to provide a brace against the action of the cutter blades.

Preferably, a plurality of impeller vanes are mounted between the coaxial disks for creating a vacuum. Pairs of flails are also mounted between the coaxial disks in this preferred embodiment to articulate together in the space between impeller vanes. Accordingly, material to be shredded that passes through the cutter blades, will normally be reduced in size but will be further shredded by the beating action of the flails. Since the flails articulate, they can move away from heavy objects such as rocks, etc.

The preferred embodiment has a hopper opening that is larger than needed to handle wood of the rated diameter. Thus the hopper can accommodate brush or leaves that are to be shredded. Additionally, limbs which may not be closely trimmed as would be required by conventional chippers can still be accommodated by the relatively large hopper opening. If limbs have small branches, twigs and leaves, all can be simultaneously processed by a single, highly efficient, chipping and shredding operation.

Experiment has demonstrated that the bed bar and the lower edge of the hopper opening should preferably be horizontal and radially aligned with the chipper rotor. A horizontal-radial bed bar aligned at the lower edge of the hopper opening will assure efficient cutting. The brush and wood will tend to stay in its initial orientation and will not tend to yaw or wander in a radial direction from the force of the cutting blades.

A large hopper opening is preferred. For a dedicated chipper, theoretically only a circular opening is needed for the circular wood of rated diameter (although practically a square opening is used to simplify manufacturing). Here however, the preferred hopper opening would have a maximum area, where the inner and outer border would be determined by the sweep of the cutter blades. Specifically, those borders would be arcs of concentric circles. Accordingly, a highly desirable hopper opening would be a quadrant bounded by concentric circles. However, such a hopper opening is less than practical since the hopper must take a complimentary shape and would be difficult to fabricate from steel plates strong enough to handle the relatively high forces associated with chipping and shredding.

As a compromise, the concentric circular borders can be approximated by a polygon. While many small sides can approximate a circle, in more practical embodiments, one side of the hopper opening is laid as a chord of a circle. For example, the hopper opening can be a trapezoid in which the chord forms an acute angle with the lower horizontal edge and an obtuse angle with the upper horizontal edge. The fourth side of the trapezoid is kept vertical. Such a shape has the virtue of being both simple (only four sides), while still exposing a rather large area of the cutting rotor. Notably, this trapezoid need not be designed to accommodate a compact circular limb and therefore no attempt need be made to approximate a square as in known chippers.

The processor operates with flails and vanes mounted inside the rotor and knives mounted on one outside face of the rotor. Stationary or fixed teeth are mounted in the rotor housing. The vegetation is first cut by the knives on the outside of the rotor face. When the vegetation passes inside the cutting chamber, it is further reduced in size by the flails and by being sliced when the flails pass through the fixed teeth. The reduction in size of the vegetation is accomplished without the aid of a reducing screen. The vanes generate the airblast that propels processed vegetation out of the cutting chamber. The radially sucked in air also serves as a conduit to carry leaves through a hose attached to the air inlet of the rotor housing.

BRIEF DESCRIPTION OF THE DRAWINGS

The above brief description as well as other objects, features and advantages of the present invention will be more fully appreciated by reference to the following detailed description of presently preferred but nonetheless illustrative embodiments, when taken in conjunction with the accompanying drawings, wherein:

FIG. 6 is a detailed view of fixed cutter teeth cooperating with the flails illustrated in FIG. 4;

FIG. 7 is a detailed view of the junction of the hopper, housing and cutter bar of FIG. 1;

DETAILED DESCRIPTION OF THE PREFERRED EMBODIMENTS

Figure 1:
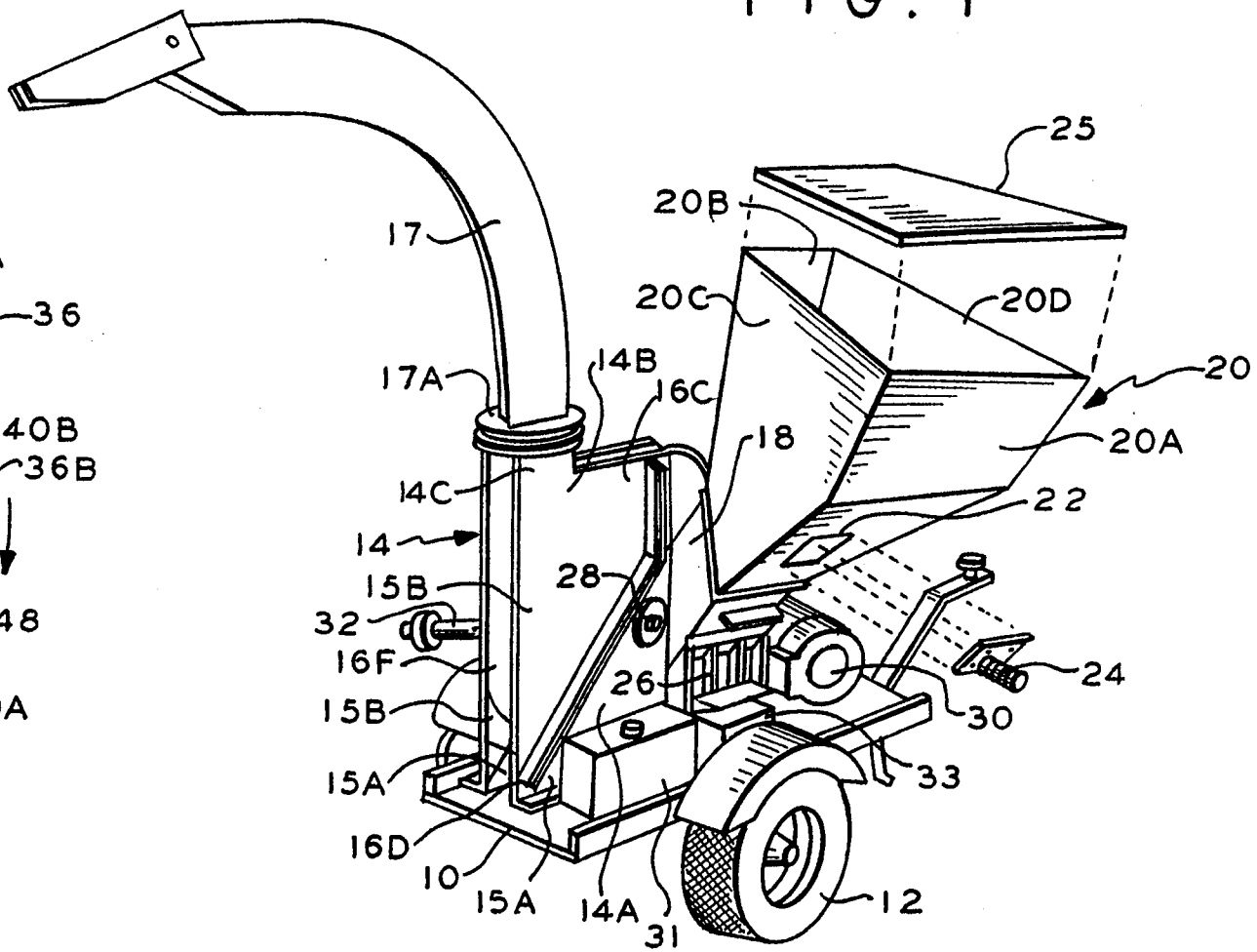
FIG. 1 is an axonometric view of a processor in accordance with the principles of the present invention.
Figure 2:
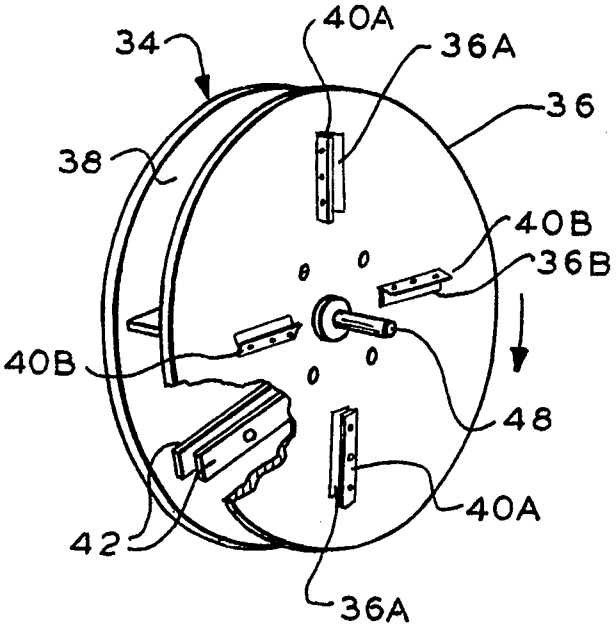
FIG. 2 is an axonometric view of the rotor, with a portion broken away for illustrative purposes, which is mounted inside the processor of FIG. 1.

Referring to FIG. 1, a processor is shown mounted on a cart comprising a platform 10 supported by a pair of wheels 12. Housing 14 is shown as a cylindrical casing comprising a pie shaped, lower shell 14A and a larger, complementary, upper shell 14B. Shells 14A and 14B are hinged at their lower left corners (this view). As described further hereinafter, shells 14A and 14B are each essentially a pair of parallel steel plates between which are mounted cylindrically curved plates.

Shells 14A and 14B meet at an angled seam bordered by flanges 16C. The vertical section of flange 16C is oriented to accommodate in shell 16B a relatively large area for hopper throat 18. Hopper throat 18 is part of hopper 20, which includes a funnelling chute having a front wall 20A, rear wall 20B and two side walls 20C and 20D. Front wall 20A is much wider than rear wall 20B to facilitate the loading of material into hopper 20. Also, front wall 20A has an upper face steeper than its lower face to keep materials from spilling from hopper 20. Welded to the side of shell 14A below hopper throat 18 are four parallel reinforcing ribs to support a cutter bar to be described presently.

The steeper portion of front wall 20A will be about 30° from vertical and its lower portion about 45° from vertical. Rear wall 20B will lean away from the processor about 10° from the vertical. Left side 20C will flair outwardly from the center of hopper 20 at about a 65°, while right side 20D will flair at about 40°.

The lower face of front wall 20A has a vacuum port 22 in the form of a square opening. Port 22 can either be covered with a plate or be connected to the flange of a vacuum hose accessory 24. As described hereinafter, the processor creates a vacuum which allows hose 24 to suck debris at a distance from the processor. When vacuum accessory 24 is used, cover 25 is fitted atop hopper 20 to ensure a high vacuum.

Housing 14 has an outlet conduit 14C which extends tangentially and vertically from the side of the housing 14. Outlet 14C is fitted with an outlet pipe 17 for throwing the shredded and chipped debris to a selected location such as a truck, cart or compost pile. Pipe 17 can swivel azimuthally, and is connected to outlet conduit 14C by a split ring shaped as the outer half of a toroid. Fitting 17 can be tightened by a bolt (not shown) spanning the split ends of the fitting.

In other embodiments, housing 14 can have a different shape and may be mounted horizontally instead. Also, the two shells can meet at different joints, at different angles, along curves, or otherwise. Also in some embodiments the housing will not employ shells that swing open; instead, access plates may be used to service the inside of the housing, while more involved servicing may require disassembling the entire housing.

A rotor (described hereinafter) is mounted inside housing 14 on bearing 28. The rotor is driven by a drive means, shown herein as gasoline motor 30. Motor 30 has an output shaft which drives a number of belts (not shown) that rotate the rotor around the bearing 28. A gas tank 31 and battery 33 may be mounted on platform 10 to support motor 30. In this embodiment, motor 30 is rated at 18 horsepower, but this rating can change depending upon the desired capacity of the processor.

In some embodiments, a self-contained motor is not employed and a separate drive shaft 32 can be connected through pulleys, belts or gearboxes directly to the axle of the rotor. Drive shaft 32 can be connected to the option driver of a tractor or other vehicle having the ability to drive an external accessory. Shaft 32 may employ a shear bolt (not shown) to disconnect the shaft should it bear an excessive load.

Referring to FIGS. 1–5, previously mentioned shell 14A is shown comprising a pair of steel, polygonal, support plates 15A each forming an obtuse angle that mates with the complimentary acute angle in the two support plates 15B. Cylindrical side wall 16G is shown extending (FIG. 4) about 220° in a circular arc around support plate 15A. Shell 14B has a corresponding support plate 15B and a spaced pair of cylindrical wall segments 16F abutting cylindrical wall 16G.

The inside and outside walls of outlet conduit 14C are shown (FIG. 4) as a pair of parallel plates 16E of different lengths that straddle plates 15B and abut the inside ends of cylindrical wall segments 16F. Walls 16E, 16F, and 16G are steel-and are welded between the support plates 15A and 15B.

Figure 4:
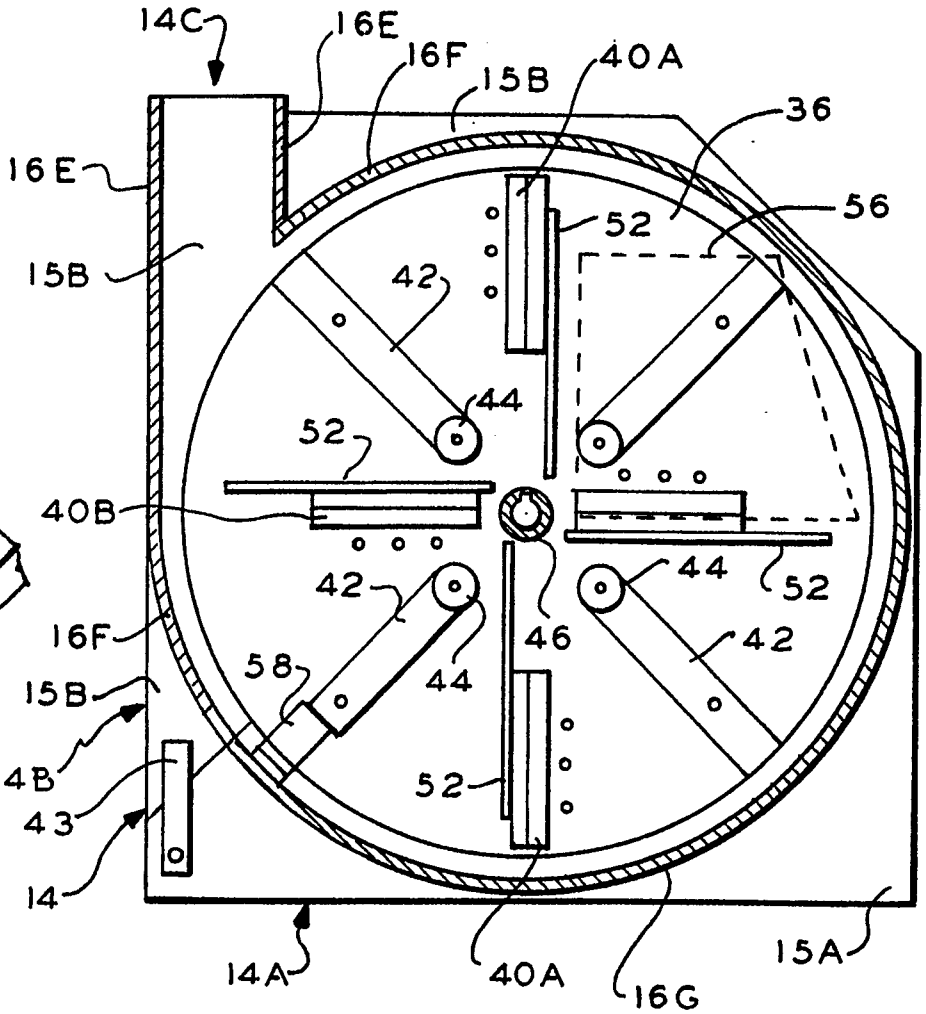
FIG. 4 is a side view taken along line 4—4 of FIG. 3 and showing parts of the housing.

Shells 14A and 14B can swing apart and are hinged at the lower left corners (FIG. 4). A hinge plate 43 is shown welded to support plate 15B and pivotally connected to support plate 15A. This allows plate 15B to pivot away from plate 15A and provide access to the rotor and its components.

Rotor 34 is shown as a pair of coaxial disks 36 and 38. The space between disks 36 and 38 is 3.5 inches, although this dimension will vary depending upon the capacity of the processor. In some embodiments, only one disk will be employed and the housing itself will act as a barrier to contain the material being shredded. Mounted on disk 36 at right angles to each other are four cutters or blades 40A and 40B. Blades 40A are outer blades mounted at positions more radially remote than inner blades 40B. The blades however sweep two contiguous, annular areas. The blades 40A and 40B are bolted on disk 36 to project over radially extending slots 36A and 36B from their trailing edges. The slots 36A and 36B are each 7.5 inches long and $1\frac{3}{4}$ inch wide, although these dimensions can vary depending on the size and capacity of the machine.

Figure 5:
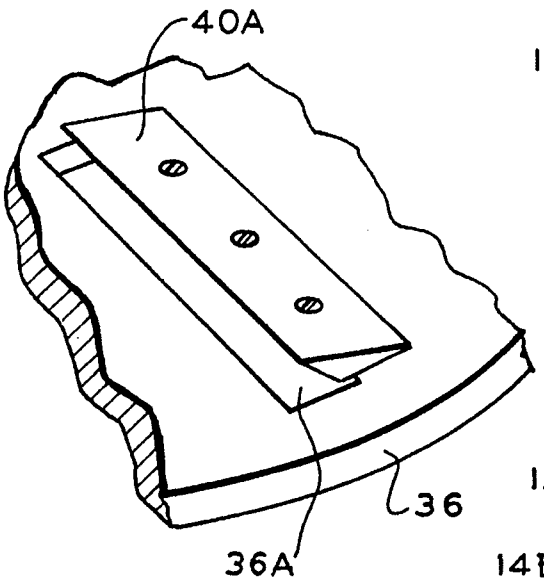
FIG. 5 is a detailed axonometric view of one of the cutter blades on the rotor of FIG. 2.

As shown in FIG. 5, cutter blades 40A (and blades 40B as well) are quadrilateral prisms made of A8 modified steel. The cutting edge is acute and its underside is relieved to direct chipped material into slot 36A.

Disks 36 and 38 are $\frac{1}{2}$ and $\frac{1}{4}$ inch thick, respectively and both are 29 inches in diameter. Disks 36 and 38 are preferably made of A36 hot rolled steel. It will be appreciated, that the size, weight and composition of the disks can be altered depending upon the capacity of the machine. In particular, disks 36 and 38 are designed to be rotated at an unloaded speed of 2250 RPM to store a predetermined amount of angular momentum. As explained before, a heavier wheel can store more angular momentum and therefore have a higher rating for chipping wood.

Four pairs of flails 42 are mounted to articulate between disks 36 and 38. Flails 42 are long rectangular plates that are connected together in pairs near their outer ends and are pivotally connected between the disks at four equiangularly spaced positions. The inner ends of each pair of flails 42 are bolted between disks 36 and 38 and positioned with spacers 44 located between and on the outer sides of the flails.

Flails 42 are shown 11 inches long and have a 1 inch space between them in this embodiment, but they can be dimensioned differently in alternate embodiments. While the flails are shown as elongate plates, in other embodiments they may be more (or less) numerous, shorter plates mounted at radially spaced positions. In other embodiments, the flails need not be rectangular but can be triangular, polygonal, round or have other shapes.

Disks 36 and 38 are coaxially welded to a keyed central hub 46, sized to receive a keyed shaft 48 (which is mounted inside bearing 28 of FIG. 1). Shaft 48 is shown attached to the drive pulleys 50, which are used by the previously mentioned motor to spin rotor 34.

Welded between disks 36 and 38 are four impeller blades 52. It will be appreciated that a different number of blades can be used and that these blades need not be straight radial plates but can be repositioned and curved to produce certain desired effects. Also, while vanes 52 are shown radially smaller than the disks, in other embodiments they can be of the same radial length (provided clearance exists).

Figure 3:
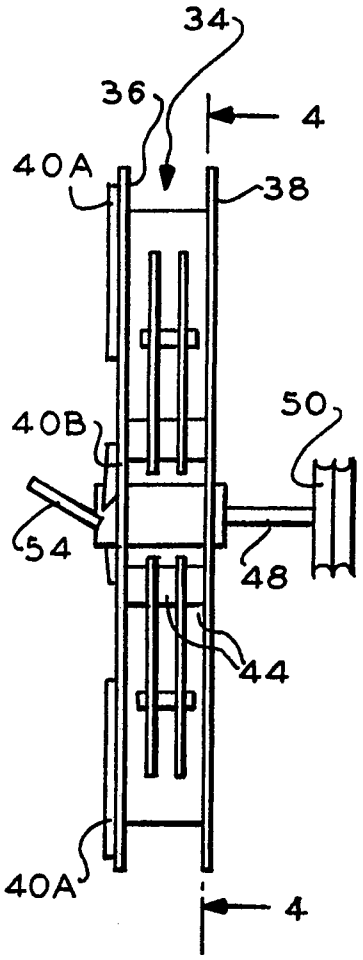
FIG. 3 is an edge view of the rotor of FIG. 2.

A stationary cutter bar 54 (sometimes referred to as a bed bar) is shown mounted in FIG. 3 at about a 45° angle to interact with cutter blades 40A and 40B. Bar 54 is vertically reinforced by previously mentioned ribs (ribs 26 of FIG. 1). Bar 54 is at the lower edge of hopper opening 56, shown in phantom in FIG. 4 as a trapezoidal hole in the side of the support plate (the support plate 15A having the hopper opening is not visible in FIG. 4 but is visible in the other Figures). The outer edge of hopper opening 56 is at about 60° to the lower edge, while the inside edge is vertical and the upper edge horizontal.

As discussed previously, hopper opening 56 can take alternate shapes, but is preferably relatively large without having an unduly complex shape. In this embodiment a four sided opening makes fabrication of the hopper relatively simple, although in some embodiments the hopper opening may be more generally polygonal, curved, or shaped otherwise.

Referring to FIGS. 4 and 6, a trio of fixed cutter teeth 58 are mounted at the lower end of cylindrical wall 16G to interdigitate with the passing flails 42. While the teeth preferably outnumber the passing flails by one, in some embodiments a single tooth can be used to pass between the two flails 42. The teeth 58 are used to dislodge debris that may become lodged between the flails 42. Teeth 58 are about 2 inches tall, 2 inches wide and ¼ inch thick and are welded to a base plate 60. In other embodiments, the teeth can have different dimensions and may be triangular, polygonal or have rounded corners or beveled edges.

Referring to FIG. 7, previously illustrated ribs 26 are shown welded to support plate 15A. The bottom plate 18A of hopper throat 18 is shown jogging downward toward the inside. This jog provides a shelf on which rests the outside edge of previously illustrated cutter bar 54. Mounted in this outside edge of bar 54 are a pair of bolts 64 which extend through unillustrated slots in the bottom plate 18A to connect to a pair of angle brackets 62. Brackets 62 connect by threaded rods 68 to tapped holes in angle bracket 70, which is welded to the underside of bottom plate 18A. With this configuration, the threaded rods 68 can be turned to adjust the spacing between bracket 70 and brackets 62. Accordingly, by adjusting rods 68 the separation between stationary bar 54 and the previously mentioned rotating cutter blades can be adjusted.

Significantly, the stationary cutter bar 54 is not exposed through the side of support plate 15A. Thus a high vacuum can be achieved through the hopper since leaking through plate 15A is avoided. Bar 54 can still be reached through the hopper throat 18 (after possibly disassembling the hopper) or by swinging open the shells 14A and 14B (FIG. 1) to gain access to the internal components.

Figure 9:
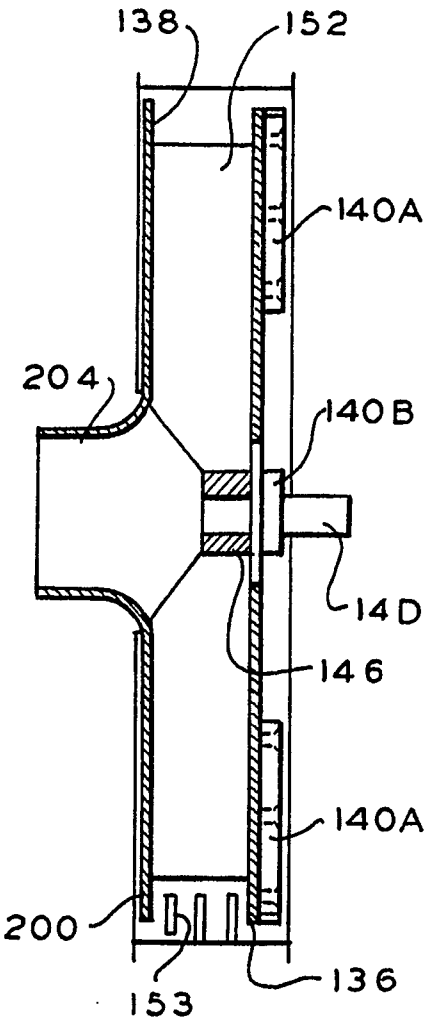
FIG. 9 is an edge view of the processor of FIG. 8.
Figure 8:
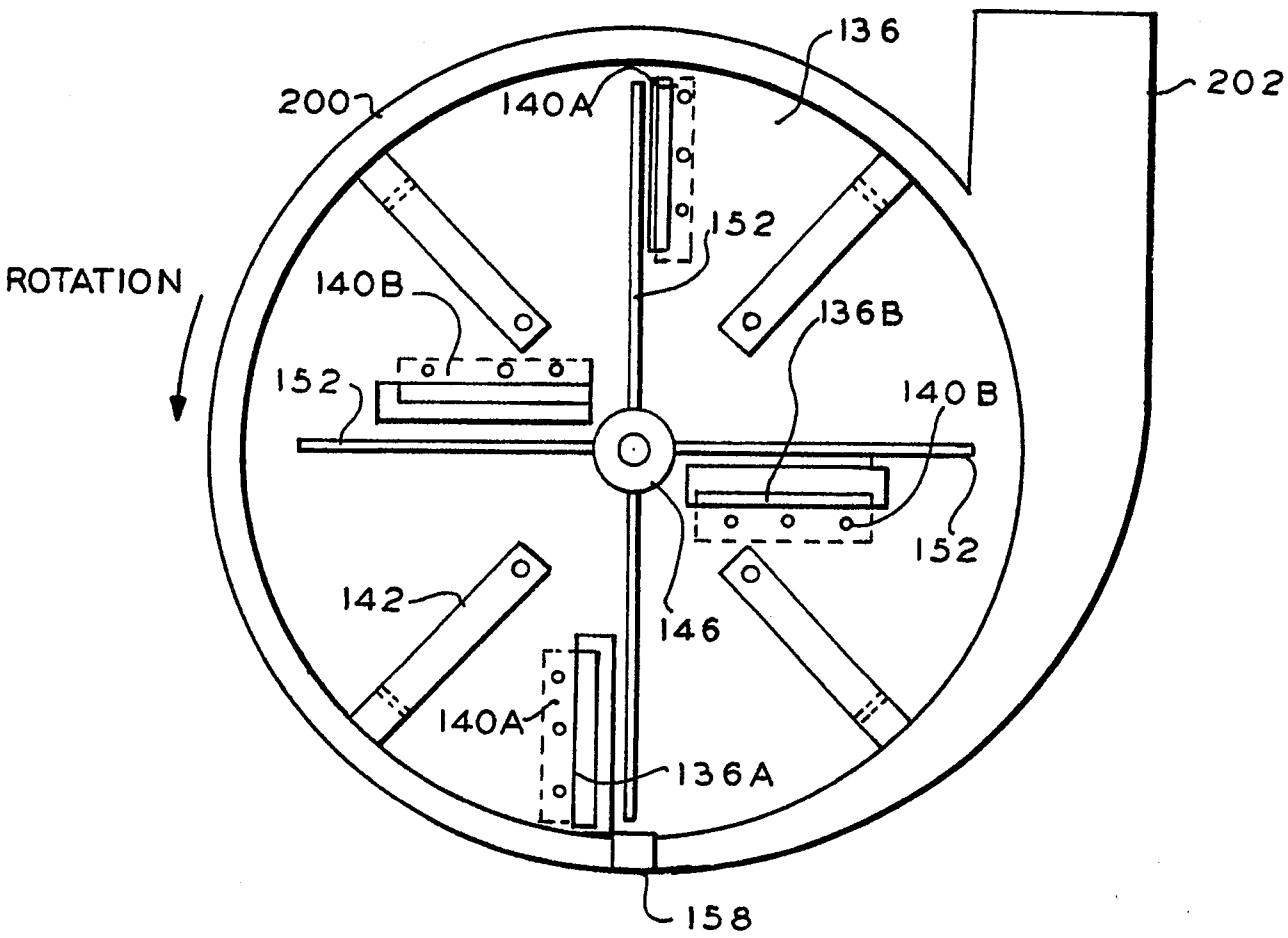
FIG. 8 is a side view of a processor which is an alternate to that of FIG. 4.

Referring to FIGS. 8 and 9, an alternate embodiment is illustrated, wherein components corresponding to those previously illustrated are incremented by one hundred. As before, a coaxial disk 136 is mounted on a hub 146 to support four flails 142 pivotally mounted to articulate on disk 136. Slots 136A and 136B cooperate with cutter blades 140A and 140B, respectively. Disk 136 and its associated components are mounted inside a generally cylindrical housing 200 having a tangential outlet 202.

Housing 200 has a concentric vacuum port 204, which is adapted to connect to a vacuum hose so that debris can be sucked into the axis of the region between coaxial disks 136 and 138. To this end, disk 138 has a large central hole. Furthermore, impeller vanes 152 have tapered inside ends to give clearance for debris entering into the central region within the housing.

To facilitate an understanding of the principles associated with the foregoing apparatus, the operation of the apparatus of FIGS. 1–7 will be briefly described, (although the operation of the apparatus of FIGS. 8–9 will be similar). Motor 30 can be started or power can be supplied through an optional drive shaft 32 (FIG. 1). Normally, in embodiments where drive shaft 32 is employed, no motor is provided and drive shaft 32 connects to support shaft 48 through pulleys, belts and gear boxes.

Once started, motor 30 spins rotor 34 to about 2,250 RPM, although others angular velocities are contemplated. Once the rated speed is achieved, an operator can place a limb into hopper 20. A relatively thick limb will not, by design, fill the entire hopper opening 56 (FIG. 4). The limb will rest initially on the upper surface of stationary cutter bar 54 which together with reinforcing ribs 26 support the limb against the action of cutter blades 40A and 40B. Cutter blades 40A and 40B will progressively chip the limb and the chips will pass through slots 36A and 36B into the space between disks 36 and 38. The chips will also be drawn in by the vacuum created by impeller vanes 52, which centrifugally impel air through outlet 14C.

Chips located between disks 36 and 38 will tend to travel through a relatively short path from approximately the 3 o'clock to the 9 o'clock position where they will then discharge through outlet path 14C into pipe 17. Some chips however will not immediately exit and will circulate one or more times inside the processor before being discharged.

In a realistic working environment, the limb may not be carefully trimmed and may include smaller branches, twigs and leaves. The relatively large hopper opening 56 can accept this smaller material. Smaller material such as leaves may pass through the cutter blades without being sufficiently mulched. For this purpose, flails 42 tend to further beat and disintegrate the material. The smaller material is lighter and may tend to circulate longer inside the processor. Nevertheless, the bulk of the material will again pass through the processor within one cycle.

In some cases agricultural waste products or yard debris such as leaves must be processed. That material may be loaded directly into hopper 20 or, if light, sucked through vacuum hose 24 (in which case cover 25 will be placed over hopper 20). In either event, hopper 20 faces upward and has a large volume for accepting debris. Hopper opening 56 has a large size for high volume processing because the opening is not constrained to a square outline simply to accommodate a large limb.

Especially when leaves, hedge clippings, vines and similar material are being processed, flails 42 may become clogged with debris. For this purpose, teeth 58 interdigitate with the flails 42 to clear them.

Because of the highly efficient arrangement where all material is initially subjected to a chipper blade, the material can pass through the processor quickly. Furthermore, the material does not need to be confined for additional cycles within the processor by using an outlet screen, as has been typical of the prior art. Because the material is processed so quickly, such a screen is unnecessary.

It is to be appreciated that various modifications may be implemented with respect to the above described preferred embodiments. For example, in some embodiments the size of the processor can be altered depending upon the desired capacity. Also the size, shape and orientation of the hopper can be altered for similar reasons. While most of the components described herein are made of welded plate steel, in other embodiments plastics, different metals and other materials can be employed instead. Furthermore various types of drive means are contemplated, including electric motors, gas turbines, PTO shafts, etc. Additionally, the number and placement of the cutter blades and the flails can be altered depending upon the processing capacity. Moreover, the vacuum accessory can be attached at a number of different points from which a vacuum can be drawn, besides those positions already illustrated.

Obviously many modifications and variations of the present invention are possible in light of the above teachings. It is therefore to be understood that within the scope of the appended claims, the invention may be practiced otherwise than as specifically described.

We claim:

1. A processor for chipping and shredding vegetation including wood and one or more of various other materials such as agricultural products, yard and garden debris, or forestry brush and waste, said processor comprising:

a housing having a hopper opening;

a rotor rotatably mounted in said housing and having an entry face and a discharge face, said hopper opening facing said entry face of said rotor, said housing having a wall facing said discharge face of said rotor and shaped to block external air from mixing with incoming airflow from said hopper opening;

at least one flail mounted to articulate on said discharge face of said rotor;

a drive means adapted to drive said rotor;

a cutter mounted on said rotor to swing past said hopper opening;

a hopper mounted at said hopper opening on said housing for feeding said material toward and past said cutter, said drive means and said rotor being sized to process solid wood having a maximum rated diameter, said hopper opening being sized to accept one or more of said various other materials in amounts exceeding said maximum rated diameter.

2. A processor according to claim 1 wherein said drive means having means for spinning said rotor unloaded and storing therein a predetermined magnitude of angular kinetic energy sufficient to chip solid wood of said rated diameter for a rated length, said rated diameter and said rated length being in a ratio typical for pruned tree limbs.

3. A processor according to claim 1 wherein said rotor has a maximum material strength that would be exceeded by processing solid wood in excess of said rated diameter.

4. A processor according to claim 1 wherein said hopper opening has a lower edge aligned radially with respect to rotation of said rotor.

5. A processor according to claim 4 wherein said lower edge is substantially horizontal.

6. A processor according to claim 4 comprising:

a stationary bar mounted at said lower edge of said hopper opening for interacting with passage of said cutter.

7. A processor according to claim 1 comprising:

at least one flail mounted to articulate on a face of said rotor opposite said hopper opening.

8. A processor according to claim 7 comprising:

at least one fixed cutter tooth circumferentially mounted on said housing to interdigitate with and clear debris from said flail.

9. A processor according to claim 1 comprising:

a pair of parallel flails mounted to articulate on a face of said rotor opposite said hopper opening; and a trio of fixed cutter teeth circumferentially mounted on said housing to interdigitate with and clear debris from said flails.

10. A processor according to claim 1 wherein said cutter comprises:

a first inner blade and a first outer blade mounted at angularly and radially spaced positions on said rotor to sweep contiguous areas.

11. A processor according to claim 10 wherein said rotor has a pair of radial slots adjacent said inner and said outer blades for passing their cuttings.

12. A processor according to claim 4 wherein each of said blades has an outside surface and a triangular cross-section with an obtuse angle opposite the outside surface.

13. A processor according to claim 10 wherein said rotor comprises:

a pair of coaxial disks, one of them supporting said blades.

14. A processor according to claim 13 comprising:

a plurality of angularly spaced, radially extending impeller vanes mounted between said disks.

15. A processor according to claim 10 wherein said rotor comprises:

a pair of coaxial disks; and a plurality of angularly spaced, radially extending impeller vanes mounted between said disks, said cutter including:

a second inner blade and a second outer blade, said first and said second inner blades and said first and said second outer blades being mounted at equiangularly spaced positions.

16. A processor according to claim 15 wherein said housing comprises:

a cylindrical casing; and an outlet conduit extending tangentially from said cylindrical casing.

17. A processor according to claim 1 comprising:

a stationary bar mounted at said hopper opening in radial alignment with said rotor for interacting with passage of said cutter, said hopper and said housing encompassing said bar without an opening in said housing below said hopper for removing said bar.

18. A processor according to claim 17 wherein said stationary bar has an upper surface inclined downwardly toward said rotor.

19. A processor according to claim 18 wherein said stationary bar is adjustable toward and away from said rotor and its cutter.

20. A processor according to claim 19 wherein said housing comprises:

a plurality of vertical reinforcing ribs strengthening said housing below said stationary bar.

21. A processor according to claim 1 wherein said drive means comprises:

a motor for rotating said rotor, said rated diameter being determined by the output power rating of said motor.

22. A processor according to claim 1 wherein said drive means comprises:

a drive shaft adapted for connection to a vehicle drive mechanism and for rotating said rotor, said rated diameter being determined by the maximum torque transmittable by said drive shaft.

23. A processor according to claim 1 wherein said hopper opening is polygonal and has one obtuse and one acute corner.

24. A processor according to claim 23 wherein said hopper opening has two orthogonal corners.

25. A processor according to claim 5 wherein said hopper opening is trapezoidal.

26. A processor according to claim 1 wherein said housing comprises:

a pair of complementary shells shaped to abut side by side along a joint, one of said shells having an acutely angled edge alone said joint, the other one of said shells being larger and supporting said hopper.

27. A processor according to claim 1 wherein said hopper comprises:

a throat attached to said hopper opening; and a funnelling chute.

28. A processor according to claim 1 wherein said hopper includes:

a front wall distal said housing; and a rear wall proximal said housing, and substantially narrower than said front wall.

29. A processor according to claim 17 wherein said hopper has a vacuum port, said processor including:

a vacuum hose removably attachable to said vacuum port on said hopper for sucking debris through said hose to said hopper.

30. A processor according to claim 29 comprising a hinged or detachable cover for said hopper for enhancing vacuum at said vacuum port.

31. A processor according to claim 1 wherein said housing has a vacuum port concentric with said rotor on a side opposite said hopper.

32. A processor according to claim 31 comprising:

a plurality of angularly spaced, radially extending impeller vanes mounted on said rotor.

33. A processor according to claim 32 wherein said impeller vanes each have a tapered inside end.

34. A processor for chipping and shredding vegetation including wood and one or more of various other materials such as agricultural products, yard and garden debris, or forestry brush and waste, said processor comprising:

a housing having a hopper opening with, at least partially, a polygonal border having one interior obtuse angle;

a rotor rotatably mounted in said housing, said hopper opening having a lower edge aligned radially with respect to rotation of said rotor;

drive means adapted to drive said rotor;

a cutter mounted on said rotor to swing past said opening;

a stationary bar mounted at said lower edge of said hopper opening for interacting with passage of said cutter; and a hopper mounted at said hopper opening on said housing for feeding said material toward and past said cutter.

35. A processor according to claim 34 wherein said lower edge is substantially horizontal.

36. A processor according to claim 34 comprising:

at least one flail mounted to articulate on a face of said rotor opposite said hopper opening.

37. A processor according to claim 36 comprising:

at least one fixed cutter tooth circumferentially mounted on said housing to interdigitate with and clear debris from said flail.

38. A processor according to claim 34 comprising:

a pair of parallel flails mounted to articulate on a face of said rotor opposite said hopper opening; and a trio of fixed cutter teeth circumferentially mounted on said housing to interdigitate with and clear debris from said flails.

39. A processor according to claim 34 wherein said cutter comprises:

a first inner blade and a first outer blade mounted at angularly and radially spaced positions on said rotor to sweep contiguous areas.

40. A processor according to claim 39 comprising:

a plurality of angularly spaced, radially extending impeller vanes mounted on said rotor.

41. A processor according to claim 34 comprising:

a stationary bar mounted at said hopper opening in radial alignment with said rotor for interacting with passage of said cutter, said hopper and said housing encompassing said bar without an opening in said housing below said hopper for removing said bar.

42. A processor according to claim 34 wherein said hopper opening is polygonal and has one interior acute angle.

43. A processor according to claim 42 wherein said hopper opening has two orthogonal corners.

44. A processor according to claim 34 wherein said hopper opening is trapezoidal.

45. A processor according to claim 34 wherein said housing comprises:

a pair of complementary shells shaped to abut side by side along a joint, one of said shells having an acutely angled edge along said joint, the other one of said shells being larger and supporting said hopper.

46. A processor according to claim 34 wherein said hopper includes:

a front wall distal said housing; and a rear wall proximal said housing, and substantially narrower than said front wall.

47. A processor according to claim 34 wherein said hopper has a vacuum port, said processor including:

a vacuum hose removably attachable to said vacuum port on said hopper for sucking debris through said hose to said hopper.

48. A processor according to claim 34 wherein said housing has a vacuum port concentric with said rotor on a side opposite said hopper.

49. A processor according to claim 48 comprising:

a plurality of angularly spaced, radially extending impeller vanes mounted on said rotor.

50. A processor according to claim 49 wherein said impeller vanes each have a tapered inside end.

51. A processor for chipping and shredding vegetation including wood and one or more of various other materials such as agricultural products, yard and garden debris, or forestry brush and waste, said processor comprising:

a housing having a hopper opening with, at least partially, a polygonal border having one interior obtuse angle, said housing including a pair of complementary shells shaped to abut side by side along a joint, one of said shells having an acutely angled edge along said joint, the other one of said shells being larger and supporting said hopper;

a rotor rotatably mounted in said housing;

drive means adapted to drive said rotor;

a cutter mounted on said rotor to swing past said opening; and a hopper mounted at said hopper opening on said housing for feeding said material toward and past said cutter.

52. A processor for chipping and shredding vegetation including wood and one or more of various other materials such as agricultural products, yard and garden debris, or forestry brush and waste, said processor comprising:

a housing having a hopper opening with, at least partially, a polygonal border having one interior obtuse angle;

a rotor rotatably mounted in said housing;

drive means adapted to drive said rotor;

a cutter mounted on said rotor to swing past said opening; and a hopper mounted at said hopper opening on said housing for feeding said material toward and past said cutter, said hopper including (a) a front wall distal said housing, and (b) a rear wall proximal said housing, and substantially narrower than said front wall.

53. A processor for chipping and shredding vegetation including wood and one or more of various other materials such as agricultural products, yard and garden debris, or forestry brush and waste, said processor comprising:

a housing having a hopper opening with, at least partially, a polygonal border having one interior obtuse angle;

a rotor rotatably mounted in said housing;

drive means adapted to drive said rotor;

a cutter mounted on said rotor to swing past said opening; and a hopper mounted at said hopper opening on said housing for feeding said material toward and past said cutter, said housing having a vacuum port concentric with said rotor on a side opposite said hopper.

* * * * *